US007581482B1

(12) United States Patent
Cler et al.

(10) Patent No.: US 7,581,482 B1
(45) Date of Patent: Sep. 1, 2009

(54) SUPERSONIC TURNING VANE

(75) Inventors: Daniel L. Cler, Coatesville, PA (US); David Forliti, Amherst, NY (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 132 days.

(21) Appl. No.: 11/460,694

(22) Filed: Jul. 28, 2006

Related U.S. Application Data

(60) Provisional application No. 60/595,696, filed on Jul. 28, 2005.

(51) Int. Cl.
*F41A 21/36* (2006.01)

(52) U.S. Cl. ..... 89/14.3

(58) Field of Classification Search ..... 89/14.3, 89/14.2, 14.4, 14.6
See application file for complete search history.

(56) References Cited

U.S. PATENT DOCUMENTS

| | | | | | |
|---|---|---|---|---|---|
| 1,363,058 | A * | 12/1920 | Schneider | 89/14.3 |
| 1,555,026 | A * | 9/1925 | Rose | 89/14.3 |
| 1,854,974 | A * | 4/1932 | Bernat | 181/223 |
| 1,948,496 | A * | 2/1934 | Barnes | 89/14.3 |
| 1,994,458 | A * | 3/1935 | Barnes | 89/14.3 |
| 2,376,331 | A * | 5/1945 | Abrams | 89/36.08 |
| 2,457,802 | A * | 1/1949 | Bauer | 89/14.3 |
| 2,567,826 | A * | 9/1951 | Prache | 89/14.3 |
| 2,778,278 | A * | 1/1957 | Schwager et al. | 89/42.01 |
| 3,115,060 | A * | 12/1963 | Ashbrock et al. | 89/14.3 |
| 3,152,510 | A * | 10/1964 | Ashbrock et al. | 89/14.3 |
| 3,492,912 | A * | 2/1970 | Clifford | 89/14.3 |
| 5,036,747 | A * | 8/1991 | McClain, III | 89/14.3 |
| 5,119,716 | A * | 6/1992 | Bartolles | 89/14.3 |
| 6,216,578 | B1 * | 4/2001 | Ledys et al. | 89/14.3 |
| 2005/0252365 | A1 * | 11/2005 | Balbo et al. | 89/14.3 |

FOREIGN PATENT DOCUMENTS

| | | | |
|---|---|---|---|
| DE | 19736363 | A1 * | 2/1999 |
| WO | WO 9854533 | A1 * | 12/1998 |

* cited by examiner

*Primary Examiner*—Troy Chambers
(74) *Attorney, Agent, or Firm*—Michael C. Sachs

(57) ABSTRACT

A supersonic turning vane includes a suction side and a pressure side; the suction side including an expansion turning wall wherein the expansion turning wall creates an expansion fan that projects into the supersonic flow passage to turn supersonic flow into the turning vane; the pressure side comprising a large radius curved surface, the pressure side and the suction side converging to form a throat wherein a shock is formed upstream of the throat, the shock decelerating the supersonic flow to subsonic conditions and the pressure side turning the subsonic flow; the suction side including an outer nozzle expansion wall downstream of the throat, the outer nozzle expansion wall diverging from the pressure side to form an expansion nozzle that expands the subsonic flow to supersonic conditions.

1 Claim, 5 Drawing Sheets

| POINT NUMBER | (X,Y) COORDINATES | | |
|---|---|---|---|
| | | 38 | −1.158,.120 |
| | | 39 | −1.091,.151 |
| 1 | .074,.004 | 40 | −1.024,.181 |
| 2 | .050,.001 | 41 | −.957,.212 |
| 3 | .019,.005 | 42 | −.890,.242 |
| 4 | .005,.019 | 43 | −.823,.273 |
| 5 | .000,.046 | 44 | −.756,.304 |
| 6 | .016,.088 | 45 | −.690,.337 |
| 7 | .030,.123 | 46 | −.624,.370 |
| 8 | .042,.158 | 47 | −.559,.405 |
| 9 | .053,.193 | 48 | −.495,.442 |
| 10 | .063,.229 | 49 | −.435,.485 |
| 11 | .072,.265 | 50 | −.396,.545 |
| 12 | .080,.301 | 51 | −.411,.587 |
| 13 | .086,.338 | 52 | −.448,.613 |
| 14 | .091,.375 | 53 | −.489,.634 |
| 15 | .094,.412 | 54 | −.551,.649 |
| 16 | .093,.497 | 55 | −.613,.665 |
| 17 | .088,.544 | 56 | −.675,.680 |
| 18 | .078,.591 | 57 | −.737,.695 |
| 19 | .064,.637 | 58 | −.799,.711 |
| 20 | .045,.681 | 59 | −.861,.726 |
| 21 | .022,.723 | 60 | −.923,.742 |
| 22 | −.004,.763 | 61 | −.985,.757 |
| 23 | −.034,.800 | 62 | −1.047,.773 |
| 24 | −.068,.834 | 63 | −1.109,.788 |
| 25 | −.104,.865 | 64 | −1.171,.804 |
| 26 | −.143,.893 | 65 | −1.233,.819 |
| 27 | −.168,.933 | 66 | −1.295,.835 |
| 28 | −.159,.975 | 67 | −1.357,.850 |
| 29 | −.132,.997 | 68 | −1.419,.865 |
| 30 | −.097,1.000 | 69 | −1.481,.881 |
| 31 | −1.654,−.017 | 70 | −1.543,.896 |
| 32 | −1.581,−.006 | 71 | −1.605,.912 |
| 33 | −1.508,.006 | 72 | −1.667,.927 |
| 34 | −1.436,.021 | 73 | −1.727,.942 |
| 35 | −1.365,.041 | 74 | −1.773,.952 |
| 36 | −1.295,.065 | 75 | −1.816,.962 |
| 37 | −1.226,.092 | 76 | −1.852,.969 |

| POINT NUMBER | (X,Y) COORDINATES | | |
|---|---|---|---|
| | | 38 | −1.158,.120 |
| | | 39 | −1.091,.151 |
| 1 | .074,.004 | 40 | −1.024,.181 |
| 2 | .050,.001 | 41 | −.957,.212 |
| 3 | .019,.005 | 42 | −.890,.242 |
| 4 | .005,.019 | 43 | −.823,.273 |
| 5 | .000,.046 | 44 | −.756,.304 |
| 6 | .016,.088 | 45 | −.690,.337 |
| 7 | .030,.123 | 46 | −.624,.370 |
| 8 | .042,.158 | 47 | −.559,.405 |
| 9 | .053,.193 | 48 | −.495,.442 |
| 10 | .063,.229 | 49 | −.435,.485 |
| 11 | .072,.265 | 50 | −.396,.545 |
| 12 | .080,.301 | 51 | −.411,.587 |
| 13 | .086,.338 | 52 | −.448,.613 |
| 14 | .091,.375 | 53 | −.489,.634 |
| 15 | .094,.412 | 54 | −.551,.649 |
| 16 | .093,.497 | 55 | −.613,.665 |
| 17 | .088,.544 | 56 | −.675,.680 |
| 18 | .078,.591 | 57 | −.737,.695 |
| 19 | .064,.637 | 58 | −.799,.711 |
| 20 | .045,.681 | 59 | −.861,.726 |
| 21 | .022,.723 | 60 | −.923,.742 |
| 22 | −.004,.763 | 61 | −.985,.757 |
| 23 | −.034,.800 | 62 | −1.047,.773 |
| 24 | −.068,.834 | 63 | −1.109,.788 |
| 25 | −.104,.865 | 64 | −1.171,.804 |
| 26 | −.143,.893 | 65 | −1.233,.819 |
| 27 | −.168,.933 | 66 | −1.295,.835 |
| 28 | −.159,.975 | 67 | −1.357,.850 |
| 29 | −.132,.997 | 68 | −1.419,.865 |
| 30 | −.097,1.000 | 69 | −1.481,.881 |
| 31 | −1.654,−.017 | 70 | −1.543,.896 |
| 32 | −1.581,−.006 | 71 | −1.605,.912 |
| 33 | −1.508,.006 | 72 | −1.667,.927 |
| 34 | −1.436,.021 | 73 | −1.727,.942 |
| 35 | −1.365,.041 | 74 | −1.773,.952 |
| 36 | −1.295,.065 | 75 | −1.816,.962 |
| 37 | −1.226,.092 | 76 | −1.852,.969 |

FIG−3

SUPERSONIC TURNING VANE

CROSS-REFERENCE TO RELATED APPLICATIONS

This application claims the benefit under 35 USC 119(e) of U.S. provisional patent application 60/595,696 filed on Jul. 28, 2005, which is hereby incorporated by reference.

STATEMENT OF GOVERNMENT INTEREST

The inventions described herein may be manufactured, used and licensed by or for the U.S. Government for U.S. Government purposes.

BACKGROUND OF THE INVENTION

The invention relates in general to supersonic fluid flow and in particular to the turning of supersonic fluid flow.

As a general matter, the turning or diverting of supersonic flow is a difficult process. Some turning devices do not take into account the complexities of compressible supersonic flow and how to manage and/or mitigate the same. Accordingly, they merely utilize a subsonic type turning device in a location that may not be designed to cleanly and efficiently turn or redirect the supersonic flow. As a result, such devices may create shocks ubiquitously in numerous locations and establish a pulsating flow.

SUMMARY OF THE INVENTION

It is an object of the invention to provide a supersonic turning vane that effectively decelerates supersonic fluid flow to subsonic speed prior to turning the flow.

It is another object of the invention to provide a supersonic turning vane with a low profile.

It is a further object of the invention to provide a supersonic turning vane that is simple in construction.

Still another object of the invention is to exploit the use of expansions, shocks, and converging-diverging nozzle aspects to turn supersonic flow.

One aspect of the invention is a turning vane disposed adjacent a supersonic flow passage, the turning vane comprising a suction side and a pressure side; the suction side including an expansion turning wall, the expansion turning wall comprising an angled portion and a substantially straight portion wherein the expansion turning wall creates an expansion fan that projects into the supersonic flow passage to turn supersonic flow into the turning vane; the pressure side comprising a large radius curved surface, the pressure side and the suction side converging to form a throat wherein a shock is formed upstream of the throat, the separation-induced shock decelerating the supersonic flow to subsonic conditions and the pressure side turning the subsonic flow; the suction side including an outer nozzle expansion wall downstream of the throat, the outer nozzle expansion wall diverging from the pressure side to form an expansion nozzle that expands the subsonic flow to supersonic conditions.

Another aspect of the invention is a turning vane disposed adjacent a supersonic flow passage having a wall, the turning vane comprising a suction side and a pressure side; wherein profiles of the suction side and the pressure side are defined using a rectangular coordinate system having an origin at an intersection of the pressure side and the wall, the profile of the pressure side defined by points 1 through 30 having substantially the coordinates of points 1 through 30 in FIG. 3 and the profile of the suction side defined by points 31-76 having substantially the coordinates of points 31-76 in FIG. 3.

The invention will be better understood, and further objects, features, and advantages thereof will become more apparent from the following description of the preferred embodiments, taken in conjunction with the accompanying drawings.

BRIEF DESCRIPTION OF THE DRAWINGS

In the drawings, which are not necessarily to scale, like or corresponding parts are denoted by like or corresponding reference numerals.

FIG. 3 is a table of coordinates that define the profile of the turning vane of FIG. 2A.

DETAILED DESCRIPTION OF THE PREFERRED EMBODIMENTS

The present invention effectively decelerates supersonic fluid flow to subsonic speeds so that the flow may be efficiently turned. The downstream flow path includes an expanding passage that accelerates the high stagnation pressure flow to supersonic conditions, prior to exit. The shape of the inventive turning vane creates strategically located expansion fans and shocks. The expansion fans and shocks permit the effective deceleration of the flow for efficient subsonic turning. The turning vane is optimized to utilize the expansion and compression waves that occur when supersonic flow is diverted from the centerline of the flow passage. The invention is applicable to muzzle brakes for small and large caliber munitions, turbo machinery and/or other similar devices and applications.

Figure 1:
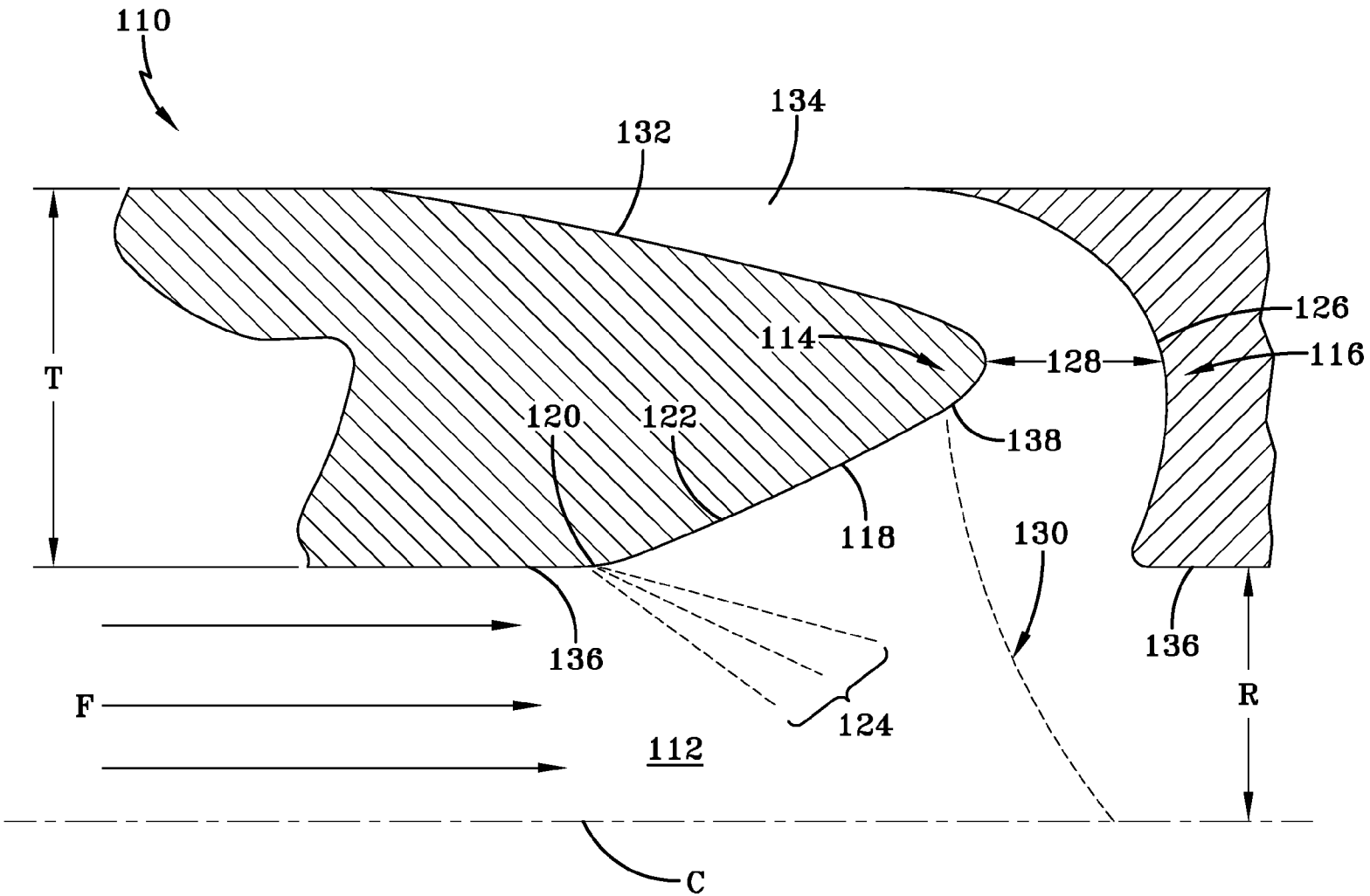
FIG. 1 is a sectional side view of one embodiment of a turning vane in accordance with the invention.

FIG. 1 is a sectional side view of one embodiment of a turning vane 110 in accordance with the invention. In FIG. 1, only half of the turning vane 110 is shown. The other half of the turning vane 110 is a mirror image of FIG. 1 disposed on the opposite side of centerline C. To construct a three-dimensional turning vane 110, the section of FIG. 1 is rotated 360 degrees around the centerline C. Supersonic fluid flows in the direction shown by the arrow F in a flow passage 112 having a centerline C, a radius R and a wall 136. The flow passage 112 may be, for example, a nozzle or the muzzle of a gun.

Turning vane 110 includes a suction side 114 and a pressure side 116. The suction side 114 includes an expansion turning wall 118 comprising an angled portion 120 and a substantially straight portion 122. The expansion turning wall 118 creates an expansion fan 124 (shown in dashed lines) that projects into the supersonic flow passage 112 to turn supersonic flow into the turning vane 110. The pressure side 116 comprises a large radius of curvature 126 relative to the chord length or passage hydraulic diameter.

The pressure side 116 and the suction side 114 converge to form a throat 128. The throat 128 is the area of minimum cross-section. A shock 130 (shown in dashed lines) is formed upstream of the throat 128. The shock 130 decelerates the supersonic flow to subsonic speed. The pressure side 116 turns the subsonic flow. The suction side 114 includes an outer nozzle expansion wall 132 downstream of the throat

128. The outer nozzle expansion wall 132 diverges from the pressure side 116 to form an expansion nozzle 134 that expands the subsonic flow to supersonic speed.

In the three-dimensional turning vane 110, a plurality of support members (not shown) connect the suction side 114 to the pressure side 116 to support the vane. The support members are disposed circumferentially around centerline C in a known manner. The turning vane 110 has a thickness T.

At angled portion 120, the wall 136 makes a relatively sharp turn and continues as a substantially straight section 122. The angled portion 120 and the substantially straight section 122 form the expansion turning wall 118 on the suction side 114 of the vane 110. The expansion turning wall 118 creates the expansion fan 124. Expansion fan 124 projects into the center core flow of the flow passage 112. The expansion fan 124 efficiently turns a portion of the supersonic flow X into the vane 110.

Slightly down the suction side 114, a shock 130 is formed due to separation in the area of point 138 along the suction side 114. The location of shock 130 is influenced by the angle of expansion wall 118, the change in radius at point 138, and the width of throat 128. The shock 130 decelerates the supersonic flow, which has been diverted by the expansion fan 124, to subsonic speeds. The subsonic flow is then turned by the pressure side 116 of the vane 110. The majority of the turning of the flow occurs at the pressure side 116. Because the flow is subsonic at the pressure side 116, the turning is very efficient. The throat 128 controls flow through the vane 110.

After the flow is turned, it is expanded in expansion nozzle 134 to supersonic speed. The pressure side 116 and the outer nozzle expansion wall 132 define nozzle 134. In nozzle 134, the pressure is reduced and additional thrust is produced. The design of vane 110 produces a relatively uniform mass flux throughout the vane. Thus, a small vane thickness T is able to achieve a high turning angle.

Figure 2A:
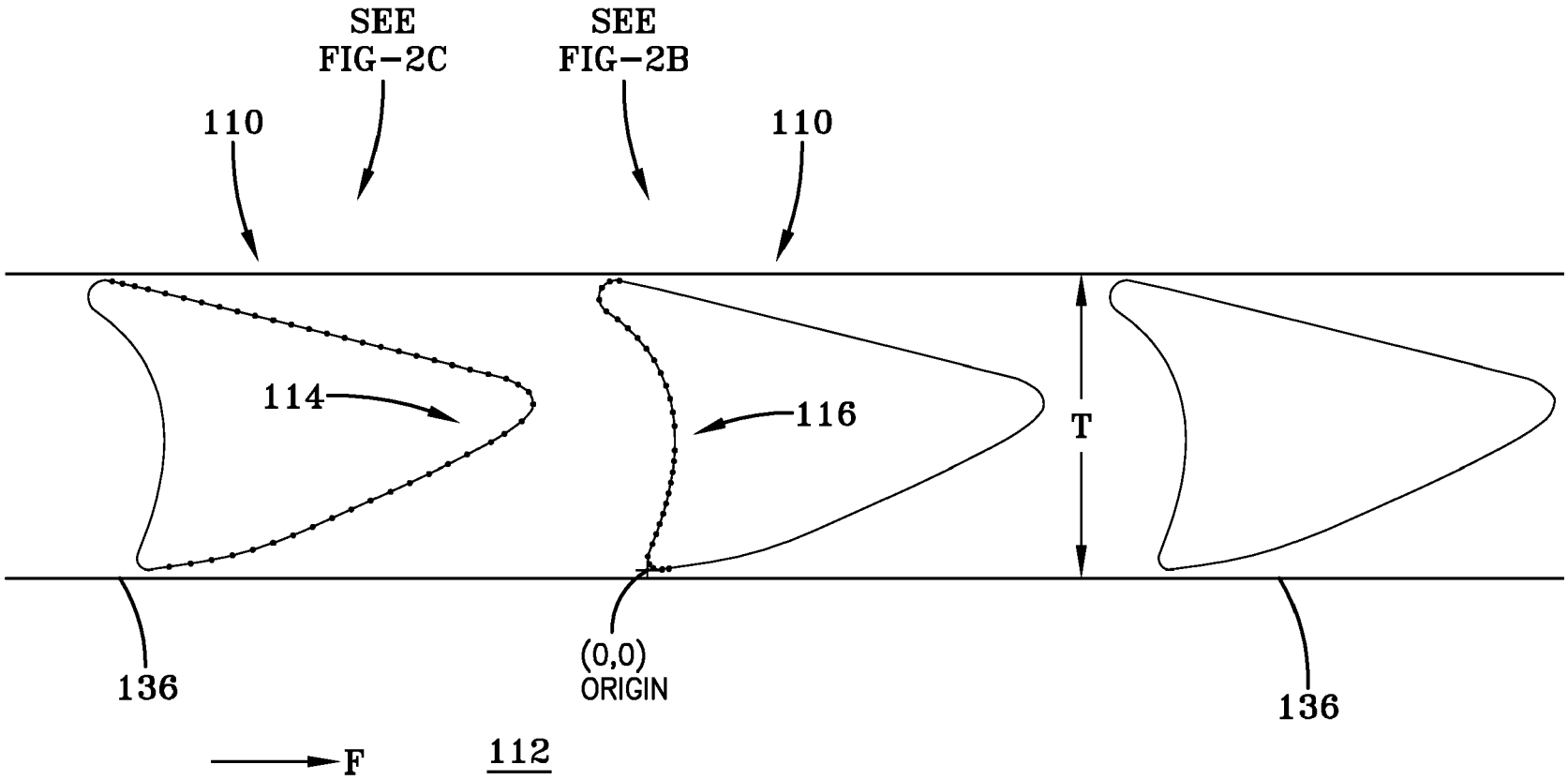
FIG. 2A is a schematic side view of the turning vane of FIG. 1, showing its dimensional relationships.

FIG. 2A is a schematic side view of the turning vane 110 of FIG. 1, showing its dimensional relationships. The method of describing the profile of vane 110 is similar to the method used for airfoils. A rectangular coordinate system has its origin 0,0 at a point near where the pressure side 116 intersects the flow passage 112. The profiles of the suction side 114 and the pressure side 116 are described by a plurality of points located on those sides and having X,Y coordinates relative to the origin 0,0. The X,Y coordinates of each point are dimensionless. The thickness T of the vane 110 is assigned a value of 1 and the coordinates of each point are relative to the thickness T. The value of the radius R of the flow passage 112 is not related to the profile of the turning vane 110.

Figure 2B:
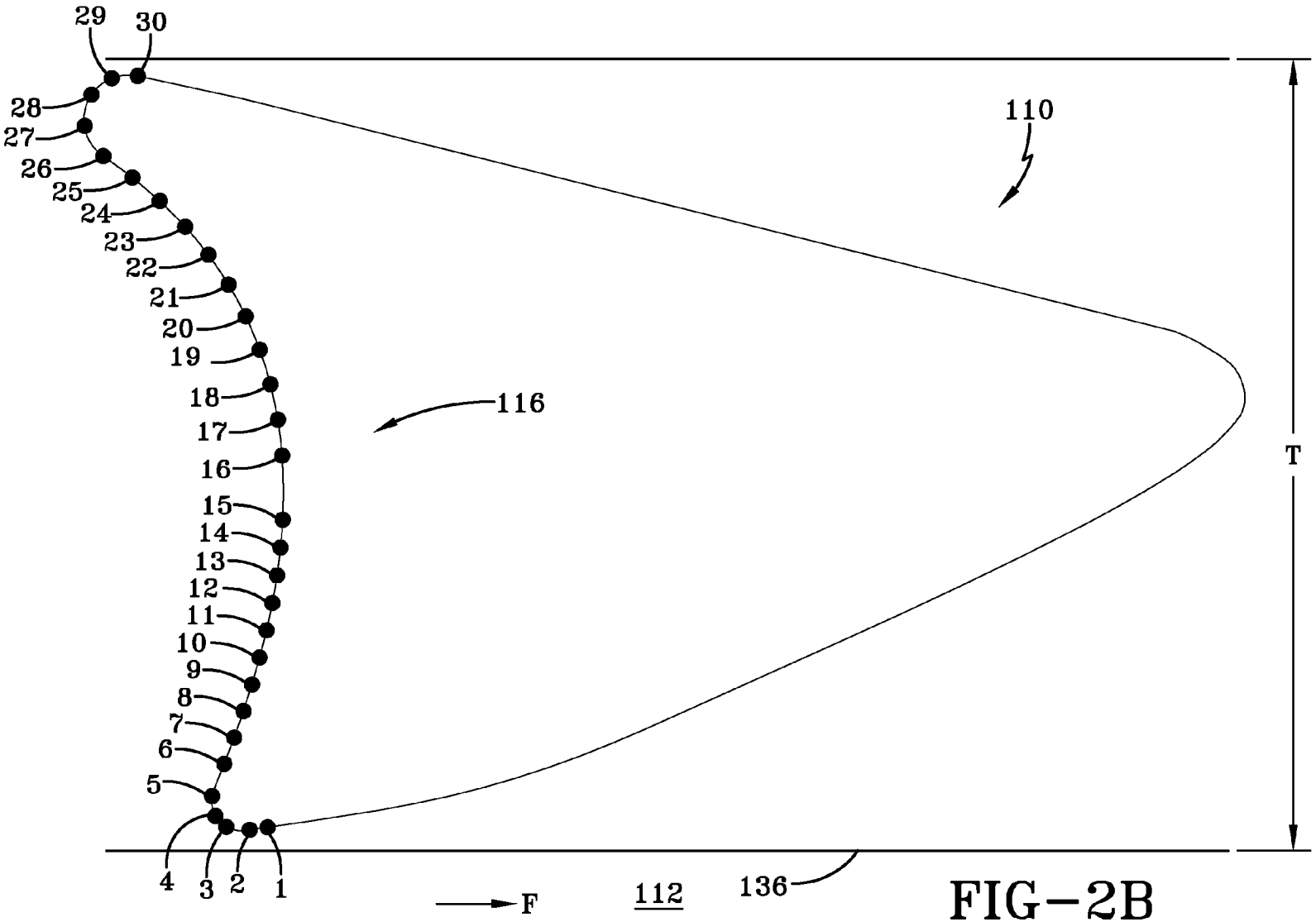
FIG. 2B is an enlarged view of the pressure side of the turning vane.
Figure 2C:
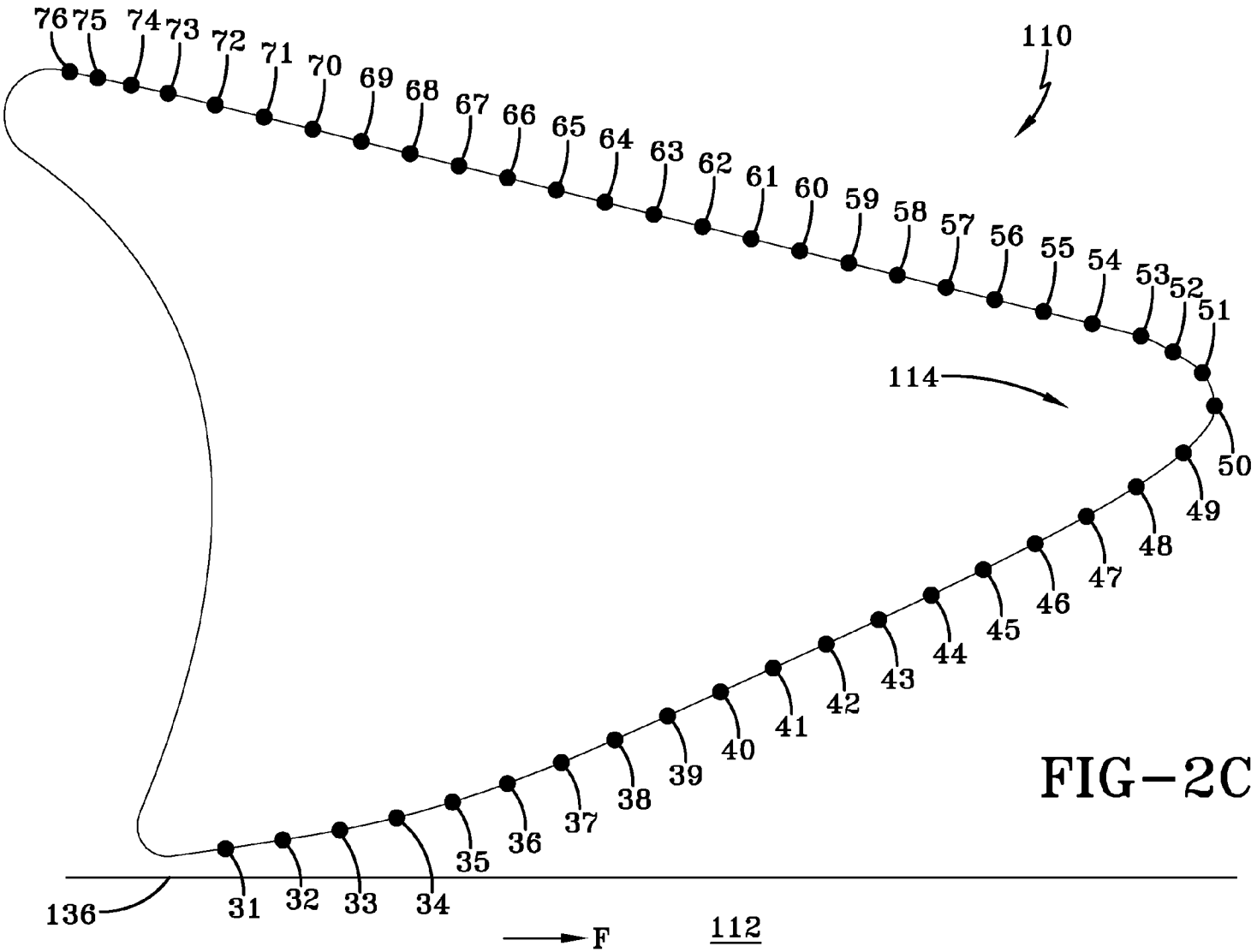
FIG. 2C is an enlarged view of the suction side of the turning vane.

In FIG. 2B, points 1-30 define the pressure side 116. In FIG. 2C, points 31-76 define the suction side 114. The X,Y coordinates for each point are given in FIG. 3. The inventive turning vane 110 has a shape such that the coordinates of its points correspond substantially to the coordinates in FIG. 3. Variations from the coordinates shown in FIG. 3 are allowable as long as the turning vane 110 functions as described above. FIGS. 2B and 2C are enlarged views of the pressure and suctions sides 116, 114, respectively.

While the invention has been described with reference to certain preferred embodiments, numerous changes, alterations and modifications to the described embodiments are possible without departing from the spirit and scope of the invention as defined in the appended claims, and equivalents thereof.

What is claimed is:

1. A turning vane disposed adjacent a supersonic flow passage having a wall, the turning vane comprising:

a suction side and a pressure side;

wherein profiles of the suction side and the pressure side are defined using a rectangular coordinate system having an origin located adjacent an intersection of the pressure side and the wall, the profile of the pressure side defined by points 1 through 30 having substantially the coordinates of points 1 through 30 in FIG. 3 and the profile of the suction side defined by points 31-76 having substantially the coordinates of points 31-76 in FIG. 3.

* * * * *